US011492917B2

(12) United States Patent
Kittleson et al.

(10) Patent No.: US 11,492,917 B2
(45) Date of Patent: Nov. 8, 2022

(54) NOZZLE WITH SLASH FACE(S) WITH SWEPT SURFACES JOINING AT ARC WITH PEAK ALIGNED WITH STIFFENING MEMBER

(71) Applicant: General Electric Company, Schenectady, NY (US)

(72) Inventors: Jacob John Kittleson, Greenville, SC (US); Robert Frank Hoskin, Lawrenceville, GA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 16/793,266

(22) Filed: Feb. 18, 2020

(65) Prior Publication Data

US 2021/0254484 A1 Aug. 19, 2021

(51) Int. Cl.
*F01D 9/04* (2006.01)
*F01D 5/14* (2006.01)

(52) U.S. Cl.
CPC ..... *F01D 9/041* (2013.01); *F01D 5/143* (2013.01); *F05D 2240/80* (2013.01)

(58) Field of Classification Search
CPC ... F01D 9/02; F01D 9/04; F01D 9/041; F01D 9/042; F01D 9/047; F01D 25/24;
(Continued)

(56) References Cited

U.S. PATENT DOCUMENTS 2,013,512 A * 9/1935 Birmann ..... F01D 9/047 415/209.2
5,634,766 A 6/1997 Cunha et al.
(Continued)

FOREIGN PATENT DOCUMENTS

EP 3869007 A1 8/2021
EP 3869012 A1 8/2021
(Continued)

OTHER PUBLICATIONS

Office Action from related U.S. Appl. No. 16/793,269 dated Jun. 23, 2021.
(Continued)

*Primary Examiner* — Courtney D Heinle
*Assistant Examiner* — Danielle M. Christensen
(74) *Attorney, Agent, or Firm* — Charlotte Wilson; James Pemrick; Hoffman Warnick LLC

(57) ABSTRACT

A nozzle for a turbine system includes an airfoil, an inner sidewall, and an outer sidewall. Each of the inner sidewall and outer sidewall includes a peripheral edge defining a pressure side slash face, a suction side slash face, a leading edge face, and a trailing edge face. At least one of the inner sidewall pressure side slash face, the inner sidewall suction side slash face, the outer sidewall pressure side slash face, or the outer sidewall suction side slash face includes a first swept surface extending at a first angle relative to a nominal slash face angle and a second swept surface extending at a second angle relative to the nominal slash face angle. The first and second swept surfaces meet at an arc having a peak that is circumferentially aligned with a stiffening member extending circumferentially on a respective sidewall.

14 Claims, 9 Drawing Sheets

(58) Field of Classification Search
CPC ..... F01D 25/246; F05D 2240/12; F05D 2240/128; F05D 2240/80; F05D 2260/941
See application file for complete search history.

(56) References Cited

U.S. PATENT DOCUMENTS

| | | | | |
|---|---|---|---|---|
| 5,807,074 | A * | 9/1998 | Fournier | F01D 9/02 415/209.3 |
| 5,813,832 | A | 9/1998 | Rasch et al. | |
| 6,290,459 | B1 | 9/2001 | Correia | |
| 6,558,121 | B2 | 5/2003 | Zhu et al. | |
| 8,147,189 | B2 | 4/2012 | Girard et al. | |
| 9,670,781 | B2 | 6/2017 | Halfmann et al. | |
| 9,874,101 | B2 | 1/2018 | Xu | |
| 9,879,542 | B2 | 1/2018 | Xu | |
| 2005/0106025 | A1 | 5/2005 | Snook et al. | |
| 2010/0028143 | A1 | 2/2010 | Bailey et al. | |
| 2010/0183435 | A1 * | 7/2010 | Campbell | F01D 5/282 415/209.3 |
| 2011/0070064 | A1 * | 3/2011 | Glynn | F01D 5/14 415/209.3 |
| 2011/0211946 | A1 * | 9/2011 | Burdgick | F01D 9/02 415/209.3 |
| 2011/0217159 | A1 | 9/2011 | McMahan et al. | |
| 2013/0011265 | A1 | 1/2013 | Miller et al. | |
| 2014/0023517 | A1 | 1/2014 | Kulkarni et al. | |
| 2015/0075178 | A1 | 3/2015 | Halfmann et al. | |
| 2016/0376898 | A1 * | 12/2016 | Azcarate Castrellon | F01D 9/047 415/208.1 |
| 2017/0183971 | A1 | 6/2017 | McDufford et al. | |
| 2019/0040755 | A1 | 2/2019 | Zemitis et al. | |

FOREIGN PATENT DOCUMENTS

| | | | |
|---|---|---|---|
| JP | 2021131088 | A | 9/2021 |
| JP | 2021131089 | A | 9/2021 |
| TW | 202132682 | A | 9/2021 |
| TW | 202132725 | A | 9/2021 |

OTHER PUBLICATIONS

European Patent Office, Extended European Search Report for corresponding EP Application No. 21154860.7, dated Jun. 23, 2021.
Final Office Action from related U.S. Appl. No. 16/793,269 dated Oct. 28, 2021, 24 pages.
Notice of Allowance from related U.S. Appl. No. 16/793,269 dated Feb. 8, 2022, 24 pages.

* cited by examiner

NOZZLE WITH SLASH FACE(S) WITH SWEPT SURFACES JOINING AT ARC WITH PEAK ALIGNED WITH STIFFENING MEMBER

BACKGROUND

The disclosure relates in general to turbine systems, such as gas turbine systems, and more particularly to nozzles in turbine systems with slash face(s) with swept surfaces meeting at a joining line that is circumferentially aligned with a stiffening member or meeting at an arc having a peak circumferentially aligned with a stiffening member.

Turbine systems are widely utilized in fields such as power generation. For example, a conventional gas turbine system includes a compressor, a combustor, and a turbine. During operation of the gas turbine system, various components in the system are subjected to high temperature flows and otherwise subjected to high stress environments. One component that is of particular concern is the nozzle. A typical turbine section nozzle includes an airfoil portion extending between inner and outer sidewalls. The peripheral edges, and in particular the pressure side and suction side slash faces, of the sidewalls require minimal hot gaps between adjacent nozzles, e.g., along singlet nozzle slash faces. Where hot deflections cause nozzle-to-nozzle interference in adjacent nozzles, larger gaps can be created, potentially leading to hot gas ingestion issues that may result in oxidation. The issue is magnified for advanced turbine systems that use a smaller number of nozzles, e.g., 36 rather than 48 nozzles, in a given turbine stage.

Slash faces may have "dogleg" profiles, which include two linear portions that meet to define an angle therebetween. Dogleg profiles are arranged to provide a shape that allows the airfoil to be easily coupled to the sidewalls, but do not address hot distortions that can lead to nozzle-to-nozzle interference. In dogleg profiles, the intersection between the linear portions creates a high stress concentration region because the dogleg is generally concave in shape. Additionally, larger concavities of the dogleg slash face shape result in increased slash face total length and leakages having adverse impact on the performance of the gas turbine. Relief radii have been introduced at the concave intersections to reduce the stress concentration level.

Alternately, slash faces may have linear profiles. For example, some edges have singular linear profiles that extend throughout the entire slash face. Singular linear profiles eliminate the high stress concentrations at the intersection. However, the construction of a slash face with a singular linear profile does not address varied hot deflections.

Fully curved slash faces have also been employed but are harder to manufacture and do not adequately address the hot deflection issue, resulting in enlarged gaps between adjacent slash faces.

BRIEF DESCRIPTION

A first aspect of the disclosure provides a nozzle for a turbine system, the nozzle comprising: an airfoil including an exterior surface defining a pressure side and a suction side extending between a leading edge and a trailing edge, the airfoil further defining a tip and a root; an inner sidewall connected to the airfoil at the tip, the inner sidewall including a peripheral edge defining a pressure side slash face, a suction side slash face, a leading edge face, and a trailing edge face; an outer sidewall connected to the airfoil at the root, the outer sidewall including a peripheral edge defining a pressure side slash face, a suction side slash face, a leading edge face, and a trailing edge face; and a stiffening member extending circumferentially on at least one of a radially inner side of the inner sidewall and a radially outer side of the outer sidewall, wherein at least one of the inner sidewall pressure side slash face, the inner sidewall suction side slash face, the outer sidewall pressure side slash face, or the outer sidewall suction side slash face includes a first swept surface extending at a first angle relative to a nominal slash face angle and a second swept surface extending at a second angle relative to the nominal slash face angle, the first swept surface and the second swept surface meeting at a joining line that is circumferentially aligned with the stiffening member.

A second aspect of the disclosure provides a nozzle assembly for a turbine system, the nozzle assembly comprising: a plurality of nozzles disposed in an annular array and defining a hot gas path, each of the plurality of nozzles including: an airfoil including an exterior surface defining a pressure side and a suction side extending between a leading edge and a trailing edge, the airfoil further defining a tip and a root; an inner sidewall connected to the airfoil at the tip, the inner sidewall including a peripheral edge defining a pressure side slash face, a suction side slash face, a leading edge face, and a trailing edge face; an outer sidewall connected to the airfoil at the root, the outer sidewall including a peripheral edge defining a pressure side slash face, a suction side slash face, a leading edge face, and a trailing edge face; and a stiffening member extending circumferentially on at least one of a radially inner side of the inner sidewall and a radially outer side of the outer sidewall, wherein at least one of the inner sidewall pressure side slash face, the inner sidewall suction side slash face, the outer sidewall pressure side slash face, or the outer sidewall suction side slash face includes a first swept surface extending at a first angle relative to a nominal slash face angle and a second swept surface extending at a second angle relative to the nominal slash face angle, the first swept surface and the second swept surface meeting at a joining line circumferentially aligned with the stiffening member.

A third aspect of the disclosure provides a gas turbine system, comprising: a compressor section; a combustor section; and a turbine section, the turbine section including a plurality of turbine stages, at least one of the plurality of turbine stages including a nozzle assembly, the nozzle assembly including a plurality of nozzles disposed in an annular array and defining a hot gas path, each of the plurality of nozzles comprising: an airfoil including an exterior surface defining a pressure side and a suction side extending between a leading edge and a trailing edge, the airfoil further defining a tip and a root; an inner sidewall connected to the airfoil at the tip, the inner sidewall including a peripheral edge defining a pressure side slash face, a suction side slash face, a leading edge face, and a trailing edge face; an outer sidewall connected to the airfoil at the root, the outer sidewall including a peripheral edge defining a pressure side slash face, a suction side slash face, a leading edge face, and a trailing edge face; and a stiffening member extending circumferentially on at least one of a radially inner side of the inner sidewall and a radially outer side of the outer sidewall, wherein at least one of the inner sidewall pressure side slash face, the inner sidewall suction side slash face, the outer sidewall pressure side slash face, or the outer sidewall suction side slash face includes a first swept surface extending at a first angle relative to a nominal slash face angle and a second swept surface extending at a second angle relative to the nominal slash face angle, the first swept surface and the second swept surface meeting at a joining line circumferentially aligned with the stiffening member, and wherein each sidewall extends arcuately greater than 7° of the annular array.

A fourth aspect of the disclosure provides a nozzle for a turbine system, the nozzle comprising: an airfoil including an exterior surface defining a pressure side and a suction side extending between a leading edge and a trailing edge, the airfoil further defining a tip and a root; an inner sidewall connected to the airfoil at the tip, the inner sidewall including a peripheral edge defining a pressure side slash face, a suction side slash face, a leading edge face, and a trailing edge face; an outer sidewall connected to the airfoil at the root, the outer sidewall including a peripheral edge defining a pressure side slash face, a suction side slash face, a leading edge face, and a trailing edge face; and a stiffening member extending circumferentially on at least one of a radially inner side of the inner sidewall and a radially outer side of the outer sidewall, wherein at least one of the inner sidewall pressure side slash face, the inner sidewall suction side slash face, the outer sidewall pressure side slash face, or the outer sidewall suction side slash face includes a first swept surface extending at a first angle relative to a nominal slash face angle and a second swept surface extending at a second angle relative to the nominal slash face angle, the first swept surface and the second swept surface meeting at an arc having a peak that is circumferentially aligned with the stiffening member.

A fifth aspect of the disclosure provides a nozzle assembly for a turbine system, the nozzle assembly comprising: a plurality of nozzles disposed in an annular array and defining a hot gas path, each of the plurality of nozzles including: an airfoil including an exterior surface defining a pressure side and a suction side extending between a leading edge and a trailing edge, the airfoil further defining a tip and a root; an inner sidewall connected to the airfoil at the tip, the inner sidewall including a peripheral edge defining a pressure side slash face, a suction side slash face, a leading edge face, and a trailing edge face; an outer sidewall connected to the airfoil at the root, the outer sidewall including a peripheral edge defining a pressure side slash face, a suction side slash face, a leading edge face, and a trailing edge face; and a stiffening member extending circumferentially on at least one of a radially inner side of the inner sidewall and a radially outer side of the outer sidewall, wherein at least one of the inner sidewall pressure side slash face, the inner sidewall suction side slash face, the outer sidewall pressure side slash face, or the outer sidewall suction side slash face includes a first swept surface extending at a first angle relative to a nominal slash face angle and a second swept surface extending at a second angle relative to the nominal slash face angle, the first swept surface and the second swept surface meeting at an arc having a peak circumferentially aligned with the stiffening member.

A sixth aspect of the disclosure provides a gas turbine system, comprising: a compressor section; a combustor section; and a turbine section, the turbine section including a plurality of turbine stages, at least one of the plurality of turbine stages including a nozzle assembly, the nozzle assembly including a plurality of nozzles disposed in an annular array and defining a hot gas path, each of the plurality of nozzles comprising: an airfoil including an exterior surface defining a pressure side and a suction side extending between a leading edge and a trailing edge, the airfoil further defining a tip and a root; an inner sidewall connected to the airfoil at the tip, the inner sidewall including a peripheral edge defining a pressure side slash face, a suction side slash face, a leading edge face, and a trailing edge face; an outer sidewall connected to the airfoil at the root, the outer sidewall including a peripheral edge defining a pressure side slash face, a suction side slash face, a leading edge face, and a trailing edge face; and a stiffening member extending circumferentially on at least one of a radially inner side of the inner sidewall and a radially outer side of the outer sidewall, wherein at least one of the inner sidewall pressure side slash face, the inner sidewall suction side slash face, the outer sidewall pressure side slash face, or the outer sidewall suction side slash face includes a first swept surface extending at a first angle relative to a nominal slash face angle and a second swept surface extending at a second angle relative to the nominal slash face angle, the first swept surface and the second swept surface meeting at an arc having a peak circumferentially aligned with the stiffening member, and wherein each sidewall extends arcuately greater than 7° of the annular array.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
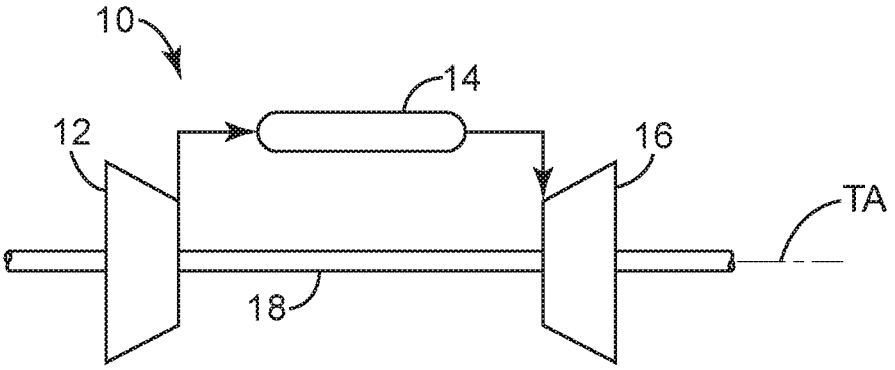
FIG. 1 is a schematic view of a gas turbine system, according to embodiments of the disclosure.

It is noted that the drawings of the disclosure are not necessarily to scale. In some cases, feature shapes, sizes, etc., have been exaggerated for purposes of illustration and understanding. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the current technology, it will become necessary to select certain terminology when referring to and describing relevant machine components within turbine system. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine engine or, for example, the flow of air through the combustor or coolant through one of the turbine's component systems. The term "downstream" corresponds to the direction of flow of the fluid, and the term "upstream" refers to the direction opposite to the flow. The terms "forward" and "aft," without any further specificity, refer to directions, with "forward" referring to the front or compressor end of the engine, and "aft" referring to the rearward or turbine end of the engine.

It is often required to describe parts that are disposed at differing radial positions with regard to a center axis. The term "radial" refers to movement or position perpendicular to an axis. In cases such as this, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis. It will be appreciated that such terms may be applied in relation to the center axis of the turbine.

In addition, several descriptive terms may be used regularly herein, as described below. The terms "first", "second", and "third" may be used interchangeably to distinguish one component from another and are not intended to signify location or importance of the individual components.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof. "Optional" or "optionally" means that the subsequently described event or circumstance may or may not occur and that the description includes instances where the event occurs and instances where it does not.

Where an element or layer is referred to as being "on," "engaged to," "connected to" or "coupled to" another element or layer, it may be directly on, engaged to, connected to, or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Embodiments of the technology provide a nozzle, a nozzle system for a turbine system, and a turbine system including the nozzle assembly. The nozzle includes an airfoil, an inner sidewall, and an outer sidewall. Each of the inner sidewall and the outer sidewall includes a peripheral edge defining a pressure side slash face, a suction side slash face, a leading edge face, and a trailing edge face. The nozzle also may include a stiffening member extending circumferentially on at least one of a radially inner side of the inner sidewall and a radially outer side of the outer sidewall. At least one of the inner sidewall pressure side slash face, the inner sidewall suction side slash face, the outer sidewall pressure side slash face, or the outer sidewall suction side slash face includes a first swept surface extending at a first angle relative to a nominal slash face angle and a second swept surface extending at a second angle relative to the nominal slash face angle. In certain embodiments, the first and second swept surfaces meet at a joining line that is circumferentially aligned with the stiffening member. In other embodiments, the first and second swept surfaces meet at an arc having a peak that is circumferentially aligned with the stiffening member. The swept surfaces provide differing gap distances between adjacent nozzle slash faces to address differing hot distortions along an axial length of the slash faces. The location of the joining line or the arc peak circumferentially aligned with the stiffening member provides stress relief and accommodates hot distortions, where necessary, to ensure minimal nozzle-to-nozzle interference.

FIG. 1 is a schematic diagram of an illustrative gas turbine system 10. It should be understood that turbine system 10 of the present disclosure need not be a gas turbine system 10, but rather may be any suitable turbine system 10, such as a steam turbine system or other suitable system. Gas turbine system 10 may include a compressor section 12, a combustor section 14, and a turbine section 16. Compressor section 12 and turbine section 16 may be coupled by a shaft 18. Shaft 18 may be a single shaft or a plurality of shaft segments coupled together to form shaft 18. Shaft defines a turbine axis TA of turbine system 10.

As is generally known in the art, air or another suitable working fluid is flowed through and compressed in compressor section 12. The compressed working fluid is then supplied to combustor section 14, wherein it is combined with fuel and combusted, creating hot gases of combustion. After the hot gases of combustion are flowed through combustor section 14, they may flow into and through turbine section 16.

Figure 2:
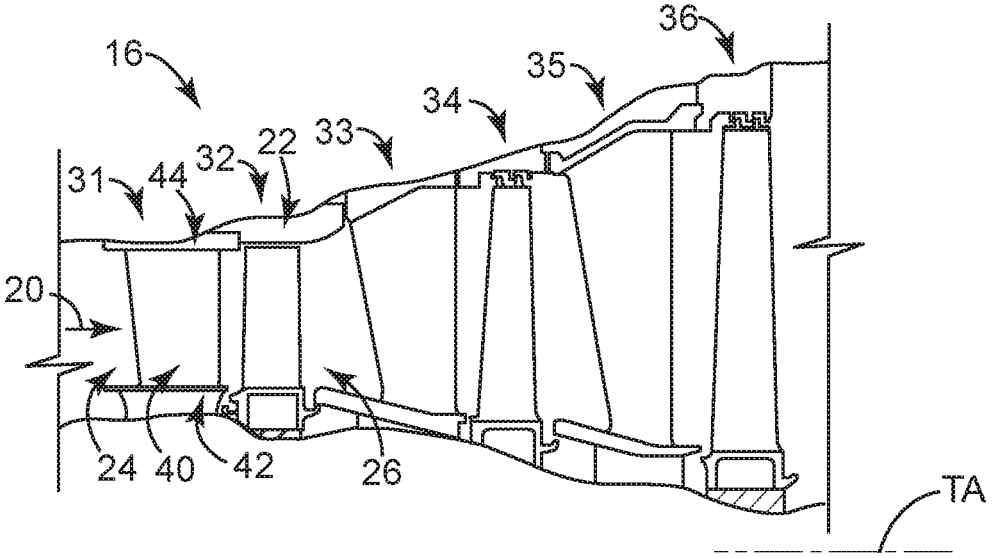
FIG. 2 is a cross-sectional view of a turbine section of a gas turbine system, according to embodiments of the disclosures.

FIG. 2 illustrates one embodiment of portions of a turbine section 16, according to the present disclosure. A hot gas path 20 may be defined within turbine section 16. Various hot gas path components, such as shrouds 22, nozzles 24, and blades 26, may be at least partially disposed in hot gas path 20. For example, as shown, turbine section 16 may include a plurality of blades 26 and a plurality of nozzles 24. Each of the plurality of blades 26 and nozzles 24 may be at least partially disposed in hot gas path 20. Further, plurality of blades 26 and plurality of nozzles 24 may be disposed in one or more annular arrays, each of which may define a portion of hot gas path 20.

Turbine section 16 may include a plurality of turbine stages. Each stage may include a plurality of nozzles 24 disposed in an annular array and a plurality of blades 26 disposed in an annular array. For example, in one embodiment, turbine section 16 may have three stages, as shown in FIG. 2. For example, a first stage of turbine section 16 may include a first stage nozzle assembly 31 and a first stage blade assembly 32. Nozzle assembly 31 may include a plurality of nozzles 24 disposed and fixed circumferentially about shaft 18. Blade assembly 32 may include a plurality of blades 26 disposed circumferentially about shaft 18 and coupled to shaft 18.

A second stage of turbine section 16 may include a second stage nozzle assembly 33 and a second stage blade assembly 34. Nozzles 24 included in nozzle assembly 33 may be disposed and fixed circumferentially about shaft 18. Blades 26 included in blade assembly 34 may be disposed circumferentially about shaft 18 and coupled to shaft 18. Second stage nozzle assembly 33 is thus positioned between first stage blade assembly 32 and second stage blade assembly 34 along hot gas path 20.

A third stage of turbine section 16 may include a third stage nozzle assembly 35 and a third stage blade assembly 36. Nozzles 24 included in nozzle assembly 35 may be disposed and fixed circumferentially about shaft 18. Blades 26 included in blade assembly 36 may be disposed circumferentially about shaft 18 and coupled to shaft 18. Third stage nozzle assembly 35 is thus positioned between second stage blade assembly 34 and third stage blade assembly 36 along hot gas path 20.

It should be understood that turbine section 16 is not limited to three stages, but rather that any number of stages are within the scope and spirit of the present disclosure. It should be understood that nozzles 24, 224 (the latter in FIG. 13) according to the present disclosure are not limited to components in turbine sections 16. Rather, nozzles 24, 224 may be components at least partially disposed in flow paths for compressor section 12 or any other suitable sections of turbine system 10.

Figure 4:
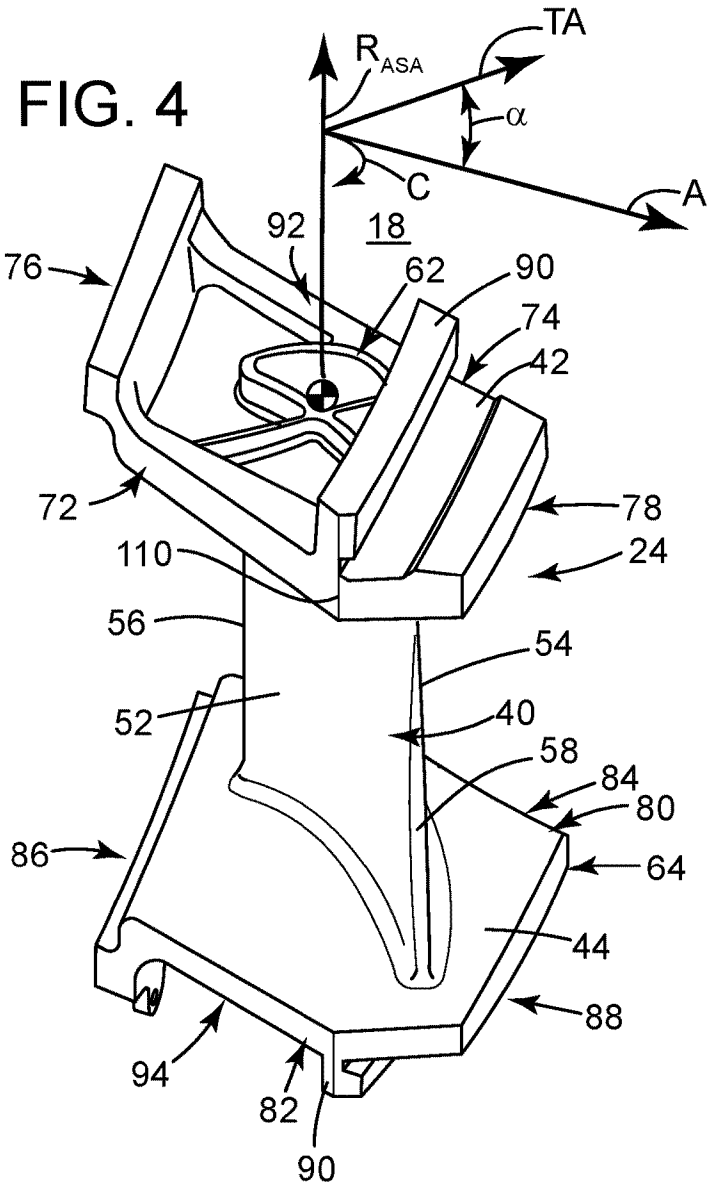
FIG. 4 is a perspective view of the nozzle of FIG. 3, as inverted, according to embodiments of the disclosure.
Figure 3:
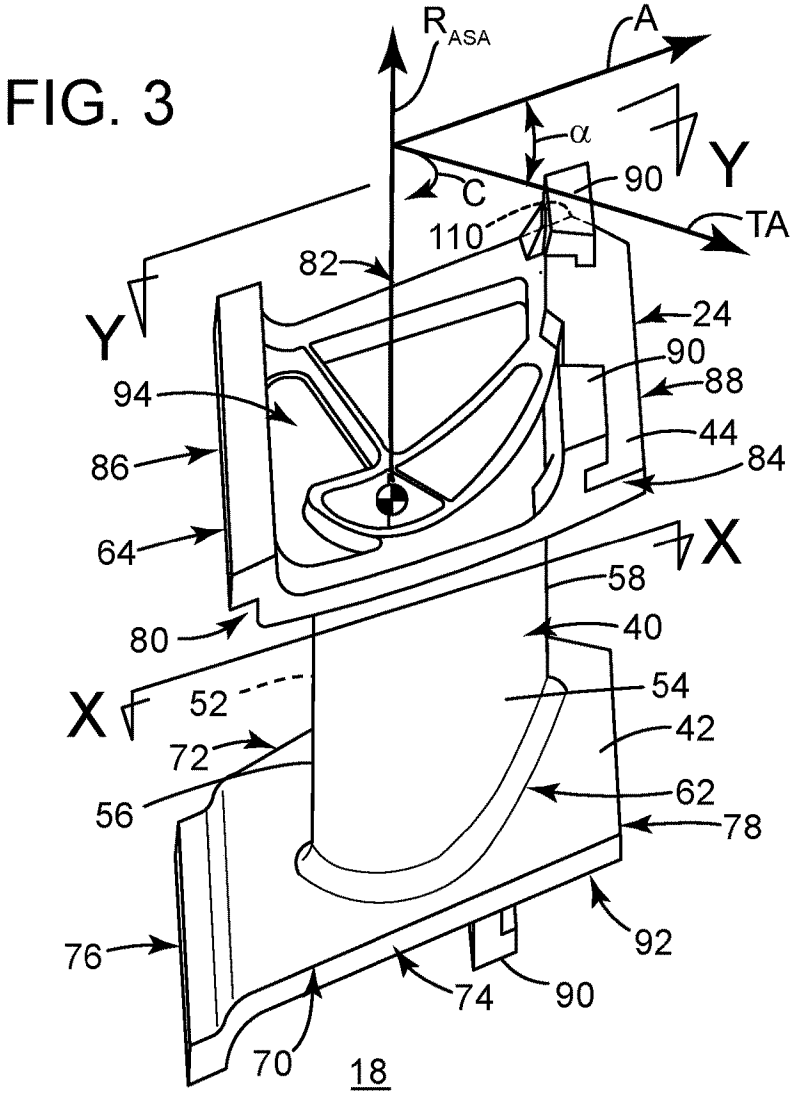
FIG. 3 is perspective view of a nozzle, according to embodiments of the disclosure.
Figure 6:
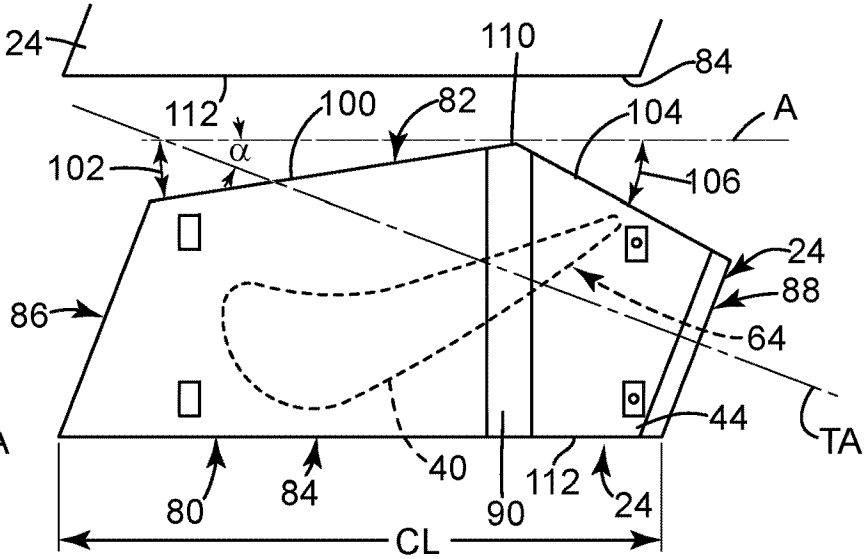
FIG. 6 is a top down view of an outer sidewall of a nozzle, according to embodiments of the disclosure, as taken along line Y-Y in FIG. 3.
Figure 5:
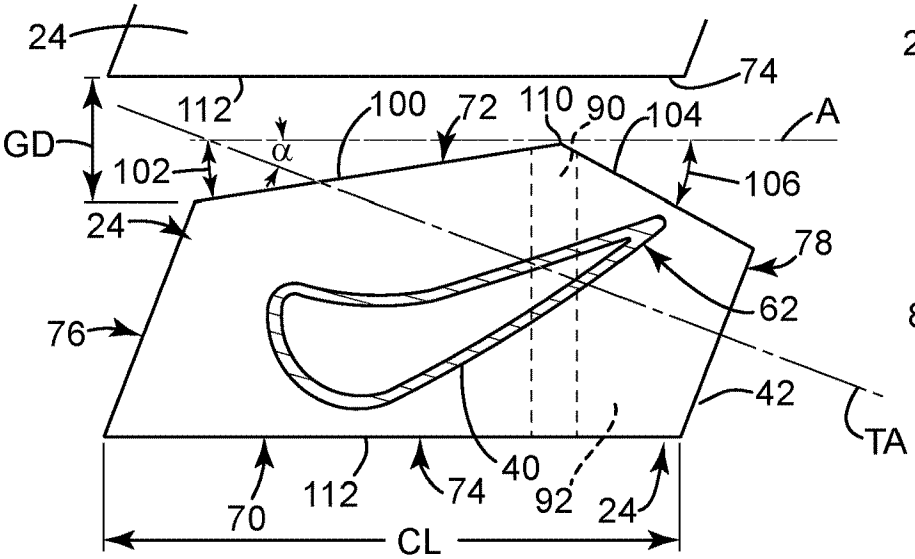
FIG. 5 is a cross-sectional view of an inner sidewall of a nozzle, according to embodiments of the disclosure, as taken along line X-X in FIG. 3.

FIG. 3 shows a side perspective view of embodiments of a nozzle 24 for turbine system 10, and FIG. 4 shows an inverted, side perspective view of nozzle 24 of FIG. 3. FIG. 5 shows a cross-sectional view of nozzle 24 along line X-X in FIG. 3, and FIG. 6 shows a top down view of nozzle 24 along line Y-Y in FIG. 3.

In illustrative embodiments, nozzle 24 is utilized in turbine section 16 of turbine system 10 and is thus included in a nozzle assembly. Further, nozzle 24 is in illustrative embodiment's first stage nozzle 24, thus utilized in first stage nozzle assembly 31. In other embodiments, however, nozzle 24 could be a second stage nozzle 24 utilized in second stage nozzle assembly 33, third stage nozzle 24 utilized in third stage nozzle assembly 35, or any other suitable nozzle utilized in any suitable stage or other assembly, in turbine section 16, compressor section 12, or otherwise.

As shown, nozzle 24 according to the present disclosure includes an airfoil 40, an inner sidewall 42, and an outer sidewall 44. Airfoil 40 extends between inner and outer sidewalls 42, 44 and is connected thereto. Airfoil 40 includes exterior surfaces defining a pressure side 52, a suction side 54, a leading edge 56, and a trailing edge 58. As is generally known, pressure side 52 and suction side 54 each generally extend between leading edge 56 and trailing edge 58. Airfoil 40 further defines and extends between a tip 62 and a root 64. Inner sidewall 42 is connected to airfoil 40 at tip 62, while outer sidewall 44 is connected at root 64.

As discussed, sidewalls 42, 44 are connected to airfoil 40. In some embodiments, nozzle 24 is formed as a single, unitary component, such as through casting or additive manufacture, and sidewalls 42, 44 and airfoil 40 are thus connected. In other embodiments, airfoil 40 and sidewalls 42, 44 are formed separately. In these embodiments, airfoil 40 and sidewalls 42, 44 may be welded, mechanically fastened, or otherwise connected together. As discussed, each nozzle 24 includes one or more airfoils 40. Each airfoil 40 extends between and is connected to sidewalls 42, 44. While one (as shown), two, three, four or more airfoils 40 may be included in nozzle 24, only one is shown for the illustrative singlet described herein for a first stage nozzle.

Further, as discussed, nozzle 24 may be included in an annular array of nozzles 24 as a nozzle assembly (e.g., first stage nozzle assembly 31). The annular array of nozzles extends about shaft 18, i.e., they are fixed circumferentially about shaft 18 to direct flow. Embodiments of the disclosure may find special applicability for nozzle assemblies that include fewer, larger nozzles, e.g., 36 nozzles rather than a higher number such as 48, which may make manufacture and maintenance easier. In this case, each nozzle 24 may include sidewalls 42, 44 that extend arcuately greater than 7° of the annular array. In one example, a first stage nozzle assembly 31 has such nozzles 24. Embodiments of the disclosure provide slash faces that address hot distortion issues that can be magnified where fewer nozzles with fewer slash faces are used.

As shown in FIG. 3 and the cross-sectional view of FIG. 5, inner sidewall 42 includes a peripheral edge 70. Peripheral edge 70 defines the periphery of inner sidewall 42. In illustrative embodiments, peripheral edge 70 may thus include and define various faces, which correspond to the various surfaces of nozzle(s) 24. For example, as shown, a peripheral edge 70 may define a pressure side slash face 72, a suction side slash face 74, a leading edge face 76, and a trailing edge face 78.

Similarly, as shown in FIG. 3 and the top-down view of FIG. 6, outer sidewall 44 includes a peripheral edge 80. Peripheral edge 80 defines the periphery of outer sidewall 44. In illustrative embodiments, peripheral edge 80 may thus include and define various faces which correspond to the various surfaces of nozzle(s) 24. For example, as shown, peripheral edge 80 may define a pressure side slash face 82, a suction side slash face 84, a leading edge face 86, and a trailing edge face 88.

As shown by the legends and arrows in FIGS. 3 and 4, each slash face 72, 74, 82, 84 of each nozzle 24 is angled at a nominal slash face angle $\alpha$ relative to turbine axis TA of the turbine system, i.e., the rotor axis. A direction of each slash face 72, 74, 82, 84, when planar, is denoted by line A in the drawings. As used herein, the "nominal slash face angle $\alpha$" is the angle of each slash face 72, 74, 82, 84, when planar, relative to turbine axis TA of the turbine system measured at a radial airfoil stacking axis (RASA) that extends through a center of gravity of airfoil 40. The nominal slash face angle is transposed to each planar slash face. Depending on the turbine system, nominal slash face angle $\alpha$ may be between 30° and 40°. As will be described herein, swept slash faces are angled relative to nominal slash face angle $\alpha$.

With reference to FIG. 3, each nozzle 24 may also include a stiffening member 90 extending circumferentially on at least one of a radially inner side 92 of inner sidewall 42 and a radially outer side 94 of outer sidewall 44. That is, a stiffening member 90 may extend circumferentially on radially inner side 92 of inner sidewall 42 and/or radially outer side 94 of outer sidewall 44. Note, FIG. 4 shows FIG. 3 in a flipped, or inverted, position, reversing the radial position of sides 92, 94.

Stiffening member 90 may include a single member or a number of members. Stiffening member 90 may be any structure that extends circumferentially on radially inner side 92 and/or radially outer side 94 of inner sidewall 42 and outer sidewall 44, respectively, and provides a thicker material that stiffens the respective sidewall 42, 44, where it is located. Stiffening member 90 may extend circumferentially across all of a sidewall or only a portion of sidewalls 42, 44. Stiffening member 90 may be provided simply as a stiffener but may also provide other functions such as, but not limited to, serving as a mounting rail or an axial loading feature.

As shown in FIGS. 5-6, stiffening member 90 is located between 50% and 100% of a chordal axial length (CL) from leading edge face 76, 86 toward trailing edge face 78, 88 of inner sidewall 42 and/or outer sidewall 44, respectively. That is, each stiffening member 90 is closer to a respective trailing edge face(s) 78, 88 than a respective leading edge face 76, 86. In another embodiment, stiffening member 90 may be located between 60% and 75% of chordal axial length (CL) from leading edge face 76, 86 toward trailing edge face 78, 88 of inner sidewall 42 and/or outer sidewall 44, respectively.

As discussed above, when the peripheral edges of a nozzle have singular planar, dogleg or curved slash faces, hot distortion may create enlarged gaps between adjacent nozzles. To address this issue, in illustrative embodiments shown best in FIGS. 5-12, at least one of inner sidewall 42 pressure side slash face 72, inner sidewall 42 suction side slash face 74, outer sidewall 44 pressure side slash face 82, or outer sidewall 44 suction side slash face 84 may include a first swept surface 100 extending at a first angle 102 relative to the nominal slash face angle $\alpha$ and a second swept surface 104 extending at a second angle 106 relative to the nominal slash face angle $\alpha$. First angle 102 faces forward, and second angle 106 faces aft.

In contrast to conventional dogleg profiles, first swept surface 100 and second swept surface 104 meet at a joining line 110 that is circumferentially aligned with stiffening member 90, i.e., in a direction about axis TA. As used herein, "circumferentially aligned" means joining line 110 is axially between the axial extents of stiffening member 90, e.g., the extent extending left-to-right across page as illustrated. Joining line 110 may extend generally radially relative to axis TA of turbine system 10. In this manner, stiffening member 90 relieves and/or absorbs stress that would otherwise exist in slash faces.

Swept surfaces 100, 104 may be linear. First angle 102 may be between 0.1° and 0.4°, and second angle 106 may be between 0.1° and 0.4° relative to a nominal slash face angle $\alpha$. Since nominal slash face angle $\alpha$ may be between 30° and 40°, swept surfaces 100, 104 may be between 29.6° and 40.4° from axis TA of turbine system 10. First angle 102 may be the same as or different than second angle 106. Axis TA (shifted for purposes of description) of turbine system 10 (FIG. 1) is illustrated in FIGS. 5-12. At ends of each slash faces 72, 74, 82, 84 with swept surfaces 100, 104, a distance from where a normally planar slash face would have met respective leading edges 76, 86 or trailing edges 78, 88 of sidewalls 42, 44, may be between, for example, 0.010-0.030 inch (0.25 millimeters (mm) to 0.76 mm). That is, 0.010-0.030 inches of material may be removed, e.g., via milling, at the corners of slash faces 72, 74, 82, 84 and leading or trailing edge faces 76, 86, 78, 88 of sidewalls 42, 44 to create swept surfaces 100, 104 at the desired angles 102, 106.

The slash faces 72, 74, 82, 84 that include swept surfaces 100, 104 may vary in their arrangement in a number of ways. In one example, shown in FIGS. 3-6, inner sidewall 42 pressure side slash face 72 and outer sidewall 44 pressure side slash face 82 each includes first swept surface 100 and second swept surface 104. In contrast, inner sidewall 42 suction side slash face 74 and outer sidewall 44 suction side slash face 84 each include a single planar surface 112. Thus, as shown in FIGS. 5 and 6, slash faces 72, 82 would be adjacent slash faces 74, 84 of adjacent nozzle having planar slash face surface 112.

In other embodiments, only one of inner sidewall 42 pressure side slash face 72, inner sidewall 42 suction side slash face 74 (shown), outer sidewall 44 pressure side slash face 82, or outer sidewall 44 suction side slash face 84 includes first swept surface 100 and second swept surface 104. That is, any single slash face 72, 74, 82, 84 on inner sidewall 42 or outer sidewall 44 may include swept surfaces 100, 104. To illustrate: in an one embodiment having inner and outer sidewalls 42, 44 shown in FIGS. 5 and 8, swept surfaces 100, 104 are only on inner sidewall 42 pressure side slash face 72 (FIG. 5). In this embodiment, both slash faces 82, 84 of outer sidewall 44 (FIG. 8), as well as suction side slash face 74 of inner sidewall 42 (FIG. 5), have planar slash faces 112.

Figure 8:
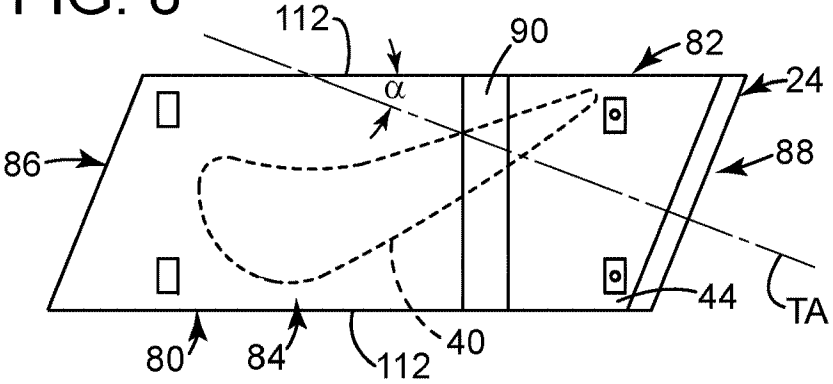
FIG. 8 is a top down view of an outer sidewall of a nozzle, according to other embodiments of the disclosure (view similar to that along line Y-Y in FIG. 3)
Figure 7:
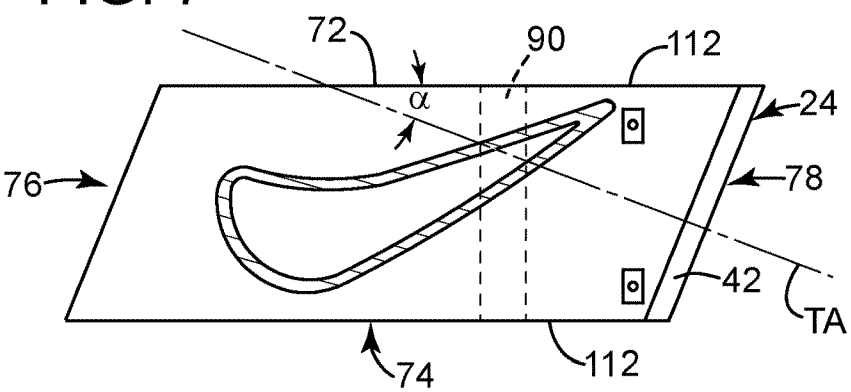
FIG. 7 is a cross-sectional view of an inner sidewall of a nozzle, according to another embodiment of the disclosure (view similar to that along line X-X in FIG. 3)
Figure 10:
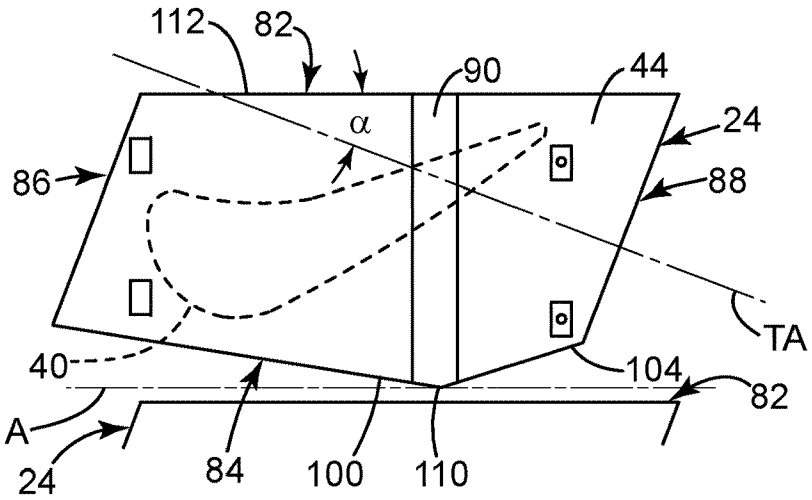
FIG. 10 is a top down view of an outer sidewall of a nozzle, according to yet other embodiments of the disclosure (view similar to that along line Y-Y in FIG. 3)
Figure 9:
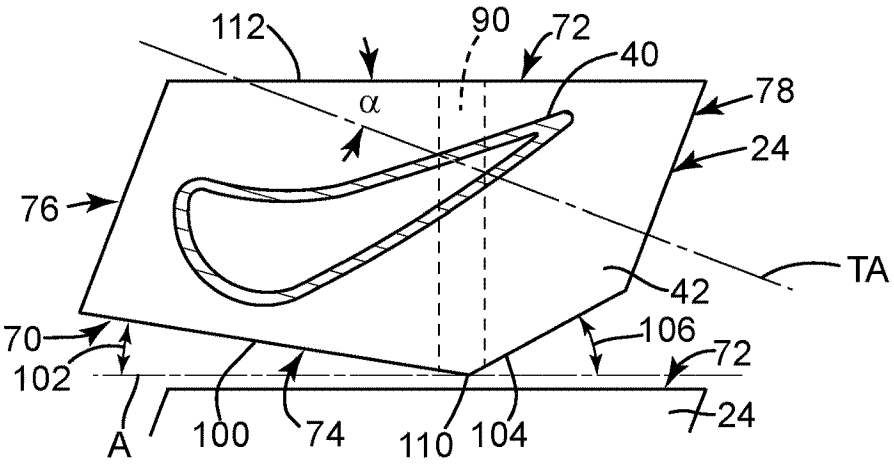
FIG. 9 is a cross-sectional view of an inner sidewall of a nozzle, according to other embodiments of the disclosure (view similar to that along line X-X in FIG. 3)

Alternatively, where inner and outer sidewalls 42, 44 are as shown in FIGS. 6 and 7, respectively, swept surfaces 100, 104 are only on outer sidewall 44 (FIG. 6) pressure side slash face 82. Here, both slash faces 72, 74 of inner sidewall 42 (FIG. 7), as well as suction side slash face 84 of outer sidewall (FIG. 6), have planar slash faces 112. In another example, where outer and inner sidewalls 44, 42 are as shown in FIGS. 8 and 9, respectively, swept surfaces 100, 104 are only on inner sidewall 42 suction side slash face 74 (FIG. 9). Here, both slash faces 82, 84 of outer sidewall 44 (FIG. 8), as well as pressure side slash face 72 of inner sidewall 42 (FIG. 9), have planar slash faces 112. In another example, where inner and outer sidewalls 42, 44 are as shown in FIGS. 7 and 10, respectively, swept surfaces 100, 104 are only on outer sidewall 44 suction side slash face 84 (FIG. 10). Here, both slash faces 72, 74 of inner sidewall 42 (FIG. 7), as well as pressure side slash face 82 of outer sidewall 44 (FIG. 10), have planar slash faces 112.

Figure 12:
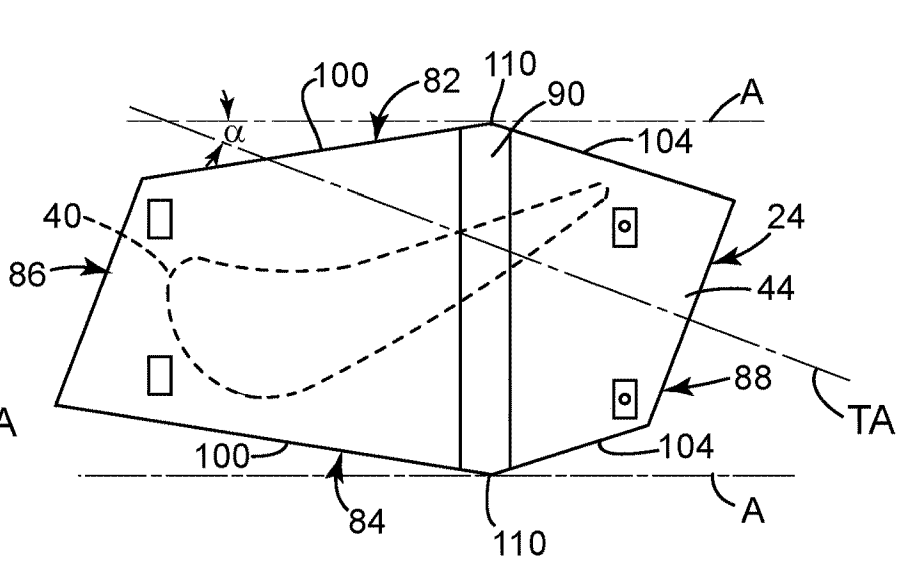
FIG. 12 is a top down view of an outer sidewall of a nozzle, according to embodiments of the disclosure (view similar to that along line Y-Y in FIG. 3)
Figure 11:
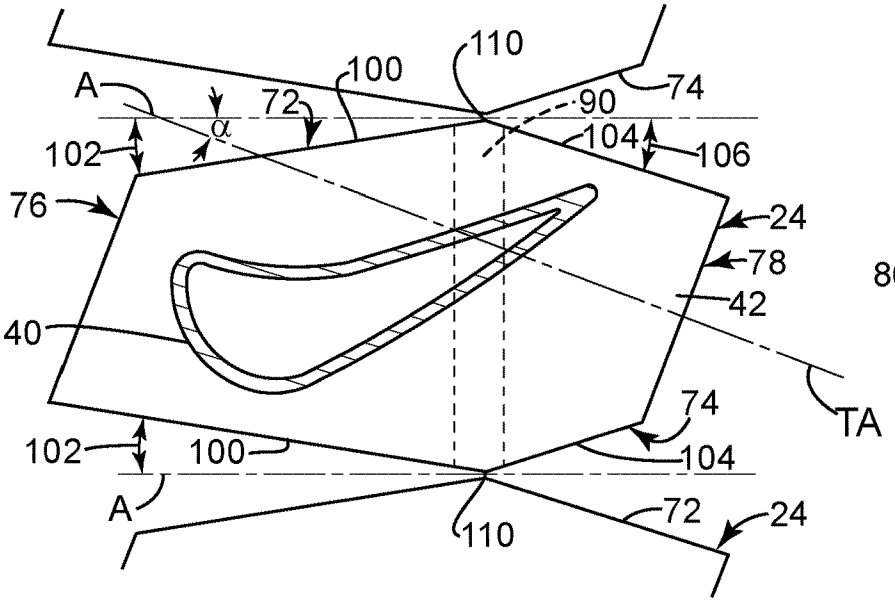
FIG. 11 is a cross-sectional view of an inner sidewall of a nozzle, according to additional embodiments of the disclosure (view similar to that along line X-X in FIG. 3)

In another embodiment, shown in FIGS. 8 and 11, and in FIGS. 7 and 12, only one sidewall on each nozzle 24 includes swept surfaces 100, 104 on both slash faces thereof. That is, both slash faces on a given sidewall include swept surfaces 100, 104, and the other sidewall has planar slash faces. FIGS. 8 and 11 show an embodiment in which both inner sidewall 42 pressure side slash face 72 and inner sidewall 42 suction side slash face 74 include swept surfaces 100, 104 (FIG. 11), while both slash faces 82, 84 on outer sidewall 44 on the same nozzle 24 include planar slash faces 112 (FIG. 8). In contrast, as shown in FIGS. 7 and 12, both outer sidewall 44 (FIG. 12) pressure side slash face 82 and outer sidewall 44 suction side slash face 84 include swept surfaces 100, 104, while both slash faces 72, 74 on inner sidewall 42 includes planar slash faces 112 (FIG. 7).

Figure 14:
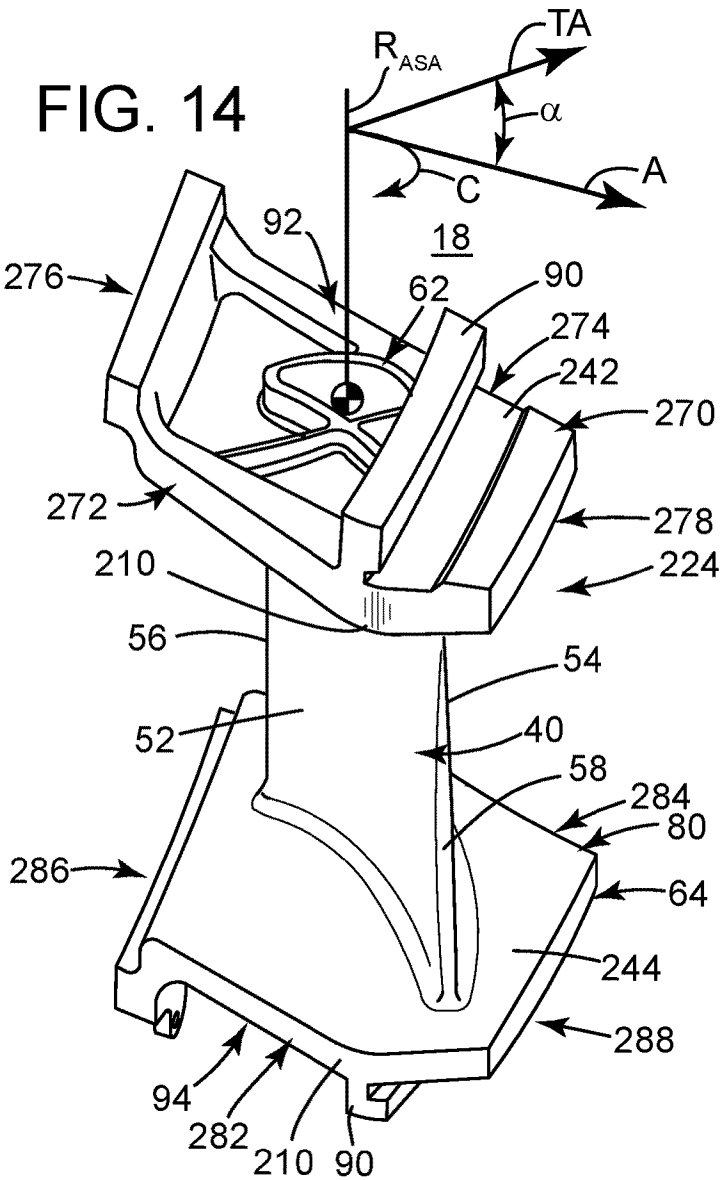
FIG. 14 is a perspective view of the nozzle of FIG. 13, as inverted, according to another embodiment of the disclosure.
Figure 13:
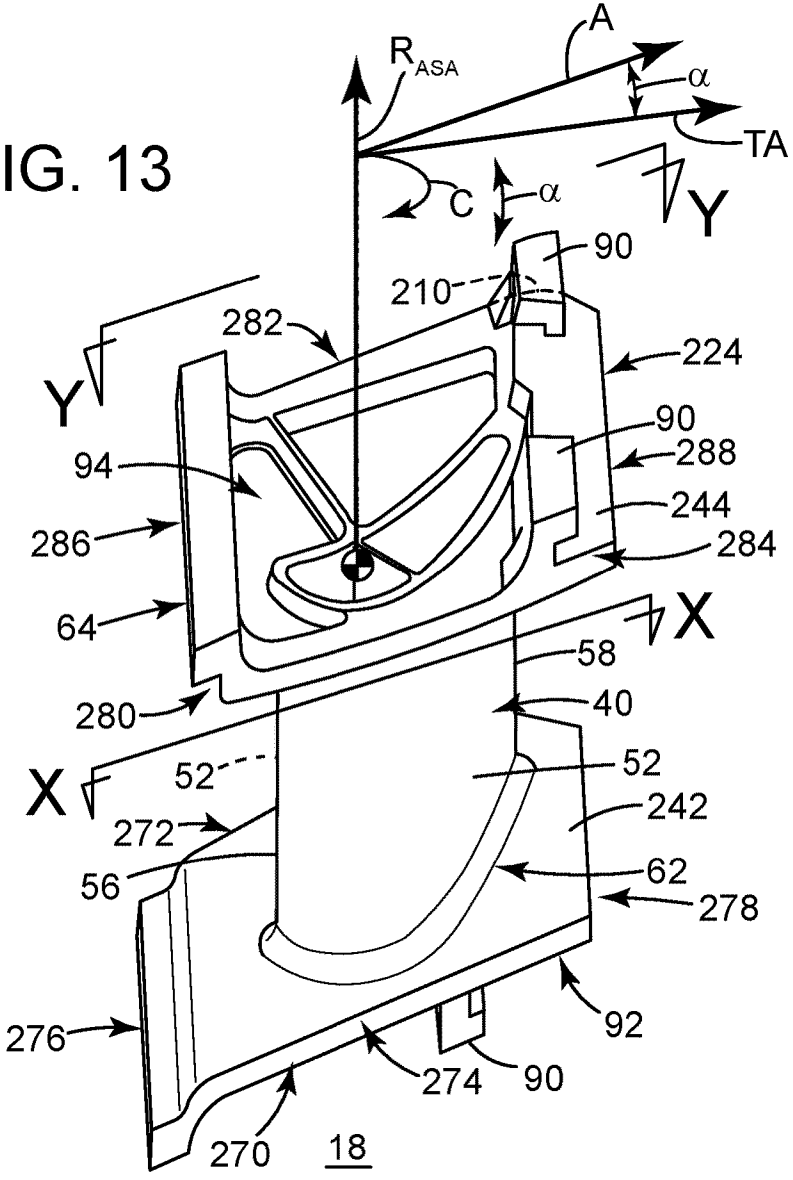
FIG. 13 is perspective view of a nozzle, according to another embodiment of the disclosure.
Figure 16:
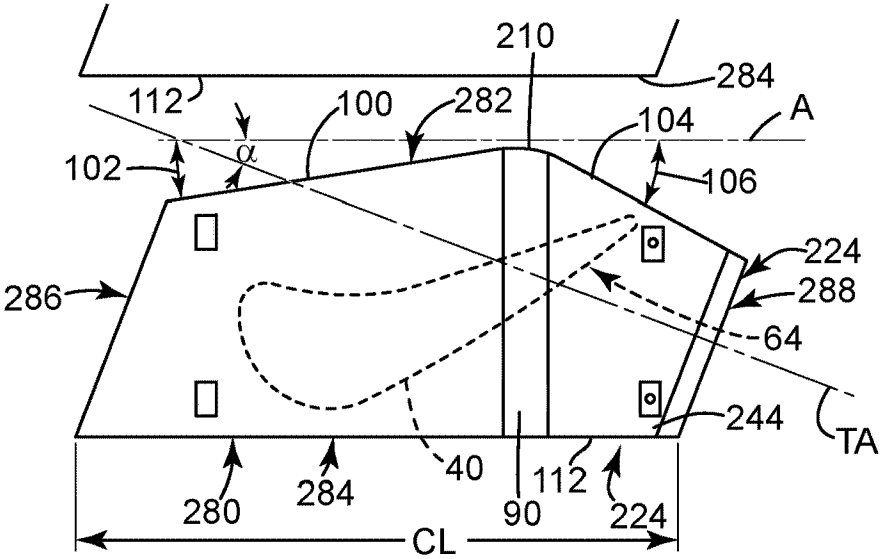
FIG. 16 is a top down view of an outer sidewall of a nozzle, according to embodiments of the disclosure, as taken along line Y-Y in FIG. 13.
Figure 15:
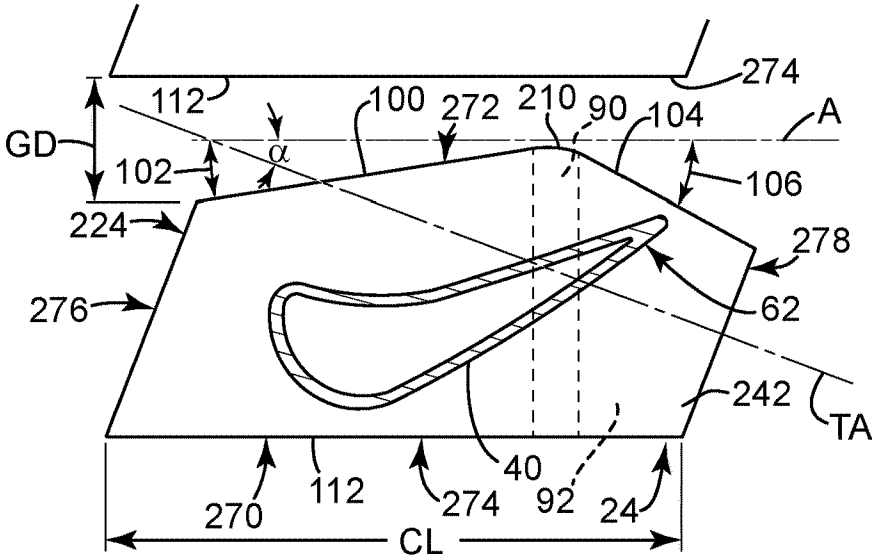
FIG. 15 is a cross-sectional view of an inner sidewall of a nozzle, according to embodiments of the disclosure, as taken along line X-X in FIG. 13.

FIGS. 13-22 show another embodiment of the disclosure that employs an arc 210 rather than a joining line 110 (see e.g., FIG. 5) where swept surfaces 100, 104 meet. FIG. 13 shows a side perspective view of embodiments of a nozzle 224 for turbine system 10, and FIG. 14 shows an inverted, side perspective view of nozzle 224 of FIG. 13. FIG. 15 shows a cross-sectional view of nozzle 14 along line X-X in FIG. 13, and FIG. 16 shows a top down view of nozzle 224 along line Y-Y in FIG. 13. In illustrative embodiments, nozzle 224 may be used as explained previously relative to nozzle 24. That is, nozzle 224 can be utilized in turbine section 16 of turbine system 10 and is thus included in a nozzle assembly (e.g., first stage nozzle assembly 31, as shown in FIG. 2).

Nozzle 224 may include similar structure to nozzle 24. For example, nozzle 224 may include airfoil 40, inner sidewall 242, and outer sidewall 244, as described herein. Airfoil 40 may also include exterior surfaces defining pressure side 52, suction side 54, leading edge 56, and trailing edge 58. Airfoil 40 also includes tip 62 and a root 64. Nozzle 224 may be formed as described relative to nozzle 24. As discussed, nozzle 224 may be included in an annular array of nozzles 224 as a nozzle assembly. Nozzle 224 may also find special applicability for nozzle assemblies that include fewer, larger nozzles, e.g., 36 nozzles rather than a higher number such as 48. In this case, each nozzle 224 may include sidewalls 242, 244 that extend arcuately greater than 7° of the annular array. In one example, a first stage nozzle assembly 31 has such nozzles 224.

As shown in FIG. 13 and the cross-sectional view of FIG. 15, inner sidewall 242 includes a peripheral edge 270 that defines the periphery of inner sidewall 242. In illustrative embodiments, peripheral edge 270 may thus include and define various faces, which correspond to the various surfaces of nozzle(s) 224. For example, as shown, peripheral edge 270 may define pressure side slash face 272, suction side slash face 274, leading edge face 276, and trailing edge face 278.

Similarly, as shown in FIG. 13 and the top-down view of FIG. 16, outer sidewall 244 includes a peripheral edge 280. Peripheral edge 280 defines the periphery of outer sidewall 244. In illustrative embodiments, peripheral edge 280 may thus include and define various faces, which correspond to the various surfaces of nozzle(s) 224. For example, as shown, peripheral edge 280 may define a pressure side slash face 282, a suction side slash face 284, a leading edge face 286, and a trailing edge face 288.

Each nozzle 224 may also include stiffening member 90 extending circumferentially on at least one of a radially inner side 92 of inner sidewall 242 and a radially outer side 94 of outer sidewall 244. That is, stiffening member 90 may extend circumferentially on radially inner side 92 of inner sidewall 242 and/or radially outer side 94 of outer sidewall 244. Note, FIG. 14 is a flipped, or inverted, image of FIG. 13 resulting in flipping of sides 92, 94. Stiffening member 90 may be as described previously herein.

As shown in FIGS. 15-16, stiffening member 90 is located between 50% and 100% of a chordal axial length (CL) from leading edge face 276, 286 toward trailing edge face 278, 288 of inner sidewall 242 and/or outer sidewall 244. That is, each stiffening member 90 is closer to a respective trailing edge face(s) 278, 288 than a respective leading edge face 276, 286. In another embodiment, stiffening member 90 may be located between 60% and 75% of chordal axial length (CL) from leading edge face 276, 286 toward trailing edge face 278, 288 of inner sidewall 242 and/or outer sidewall 244, respectively.

At least one of inner sidewall 242 pressure side slash face 272, inner sidewall 242 suction side slash face 274, outer sidewall 244 pressure side slash face 282, or outer sidewall 244 suction side slash face 284 may include a first swept surface 100 extending at first angle 102 relative to nominal slash face angle $\alpha$ and second swept surface 104 extending at a second angle 106 relative to nominal slash face angle $\alpha$. In contrast to previous embodiments' profiles, first swept surface 100 and second swept surface 104 meet at an arc 210 having a peak that is circumferentially aligned with stiffening member 90, i.e., in a direction about turbine axis TA. As used herein, "circumferentially aligned" means arc's 210 peak is axially between the axial extents of stiffening member 90, e.g., the extent extending left-to-right across page as illustrated. Arc 210 peak may extend generally radially relative to turbine axis TA of turbine system 10. In this manner, stiffening member 90 relieves and/or absorbs stress that would otherwise exist. Arc 210 may be formed by milling and may be freeform or may be configured to meet a particular shape.

Swept surfaces 100, 104 may be linear other than at arc 210. First angle 102 may be between 0.1° and 0.4°, and the second angle may be between 0.1° and 0.4° relative to nominal slash face angle $\alpha$. Nominal slash face angle $\alpha$ is the same as described relative to FIGS. 3-12, see legend in FIGS. 13 and 14. Since nominal slash face angle $\alpha$ may be between 30° and 40°, swept surfaces 100, 104 may be between 29.6° and 40.4° from axis TA of turbine system 10. First angle 102 may be the same as or different than second angle 106. The arc 210 may have any radius desired, allowing blending of the surfaces 100, 104. At ends of each slash face 272, 274, 282, 284 with swept surfaces 100, 104, a distance from where a normally planar slash face would have met respective leading or trailing edge faces 276, 286, 278, 288 of sidewalls 242, 244, may be between, for example, 0.010-0.030 inch (0.25 millimeters (mm) to 0.76 mm). That is, 0.010-0.030 inches of material may be removed, e.g., via milling, at the corners of slash faces 272, 274, 282, 284 and leading edge faces 276, 286 or trailing edge faces 278, 288 of sidewalls 242, 244 to create swept surfaces 100, 104 at the desired angles 102, 106.

As described herein relative to FIGS. 5-12, the slash faces 272, 274, 282, 284 that include swept surfaces 100, 104 meeting at arc 210 may vary. FIGS. 13-22 show similar arrangements as those of FIGS. 5-12 but including arc 210 rather than joining line 110. In one example, shown in FIGS. 15 and 16, both inner sidewall 242 pressure side slash face 272 and outer sidewall 244 pressure side slash face 282 include first swept surface 100 and second swept surface 104. In contrast, each of inner sidewall 242 suction side slash face 274 and outer sidewall 44 suction side slash face 84 include a single planar surface 112. Thus, as shown in FIGS. 15 and 16, slash faces 272, 282 would be adjacent slash faces 274, 284 of an adjacent nozzle 224 having planar slash face surface 112.

Figure 18:
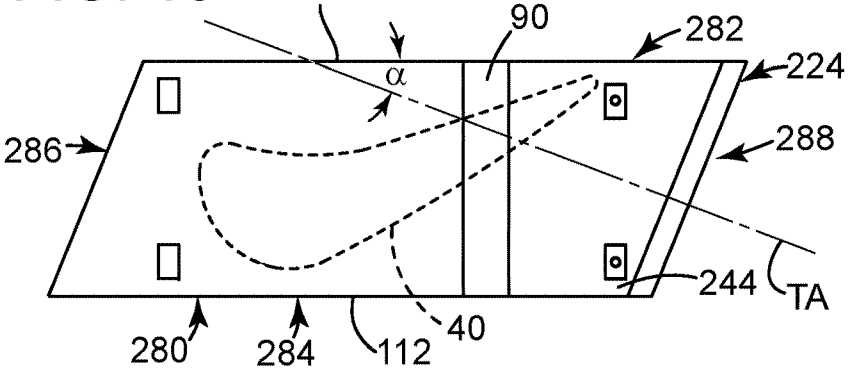
FIG. 18 is a top down view of an outer sidewall of a nozzle, according to other embodiments of the disclosure (view similar to that along line Y-Y in FIG. 13)

In other embodiments, shown with reference to FIGS. 15-20, only one of inner sidewall 242 pressure side slash face 272, inner sidewall 242 suction side slash face 274, outer sidewall 244 pressure side slash face 282, or outer sidewall 244 suction side slash face 284 includes first swept surface 100 and second swept surface 104. That is, any single slash face 272, 274, 282, 284 on inner sidewall 242 or outer sidewall 244 may include swept surfaces 100, 104. To illustrate: in an exemplary embodiment in which inner and outer sidewalls 242, 244 are as shown in FIGS. 15 and 18, respectively, swept surfaces 100, 104 are only on inner sidewall 242 pressure side slash face 272 (FIG. 15). In this embodiment, both slash faces 282, 284 of outer sidewall 244 (FIG. 18), as well as suction side slash face 274 of inner sidewall 242 (FIG. 15), have planar slash faces 112.

Figure 17:
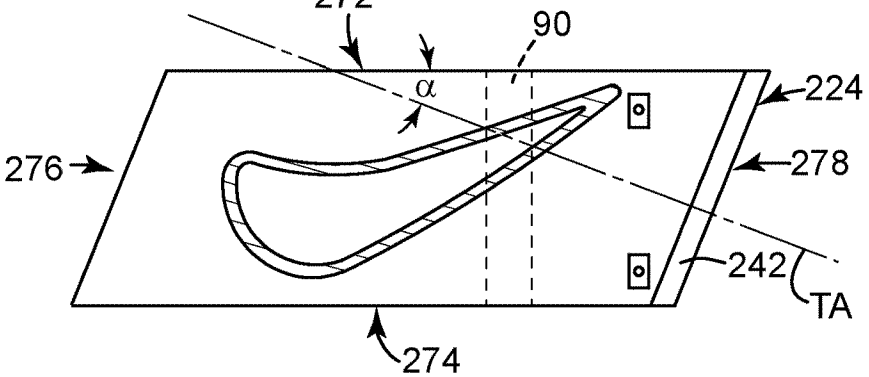
FIG. 17 is a cross-sectional view of an inner sidewall of a nozzle, according to another embodiment of the disclosure (view similar to that along line X-X in FIG. 13)
Figure 20:
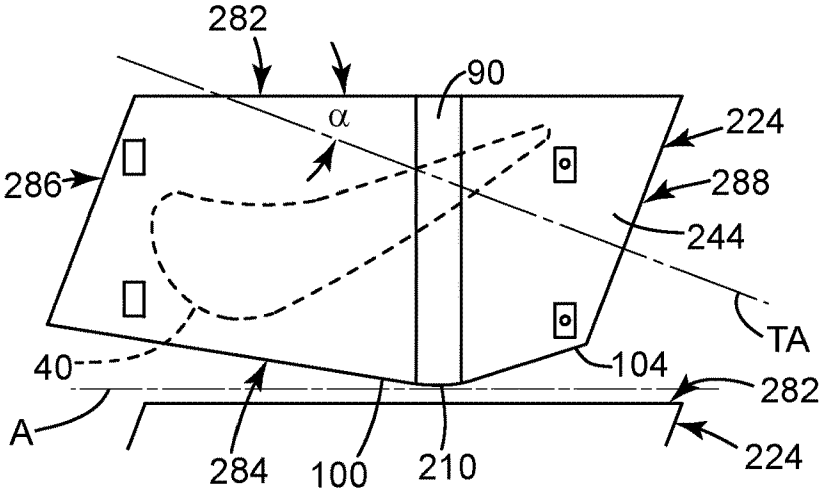
FIG. 20 is a top down view of an outer sidewall of a nozzle, according to yet other embodiments of the disclosure (view similar to that along line Y-Y in FIG. 13)
Figure 19:
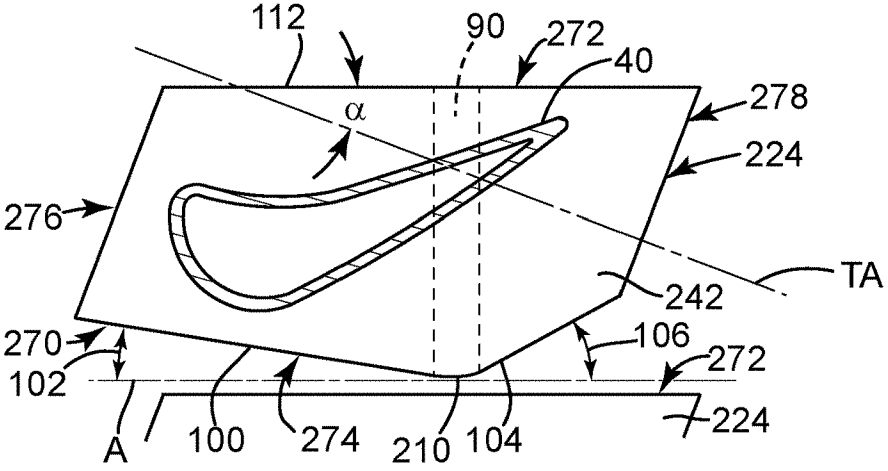
FIG. 19 is a cross-sectional view of an inner sidewall of a nozzle, according to other embodiments of the disclosure (view similar to that taken along X-X in FIG. 13)

In another example, where outer and inner sidewalls 244, 242 are as shown in FIGS. 16 and 17, respectively, swept surfaces 100, 104 are only on outer sidewall 244 pressure side slash face 282 (FIG. 16). Here, both slash faces 272, 274 of inner sidewall 242 (FIG. 17), as well as suction side slash face 284 of outer sidewall 244 (FIG. 16), have planar slash faces 112. In another example, where outer and inner sidewalls 244, 242 are as shown in FIGS. 18 and 19, respectively, swept surfaces 100, 104 are only on inner sidewall 242 suction side slash face 274 (FIG. 19). Here, both slash faces 282, 284 of outer sidewall 244 (FIG. 18), as well as pressure side slash face 272 of inner sidewall 242 (FIG. 19), have planar slash faces 112. In a final example, where inner and outer sidewalls 242, 244 are as shown in FIGS. 17 and 20, respectively, swept surfaces 100, 104 are only on outer sidewall 244 suction side slash face 284 (FIG. 20). Here, both slash faces 272, 274 of inner sidewall 242 (FIG. 17), as well as pressure side slash face 282 (FIG. 20), have planar slash faces 112.

Figure 22:
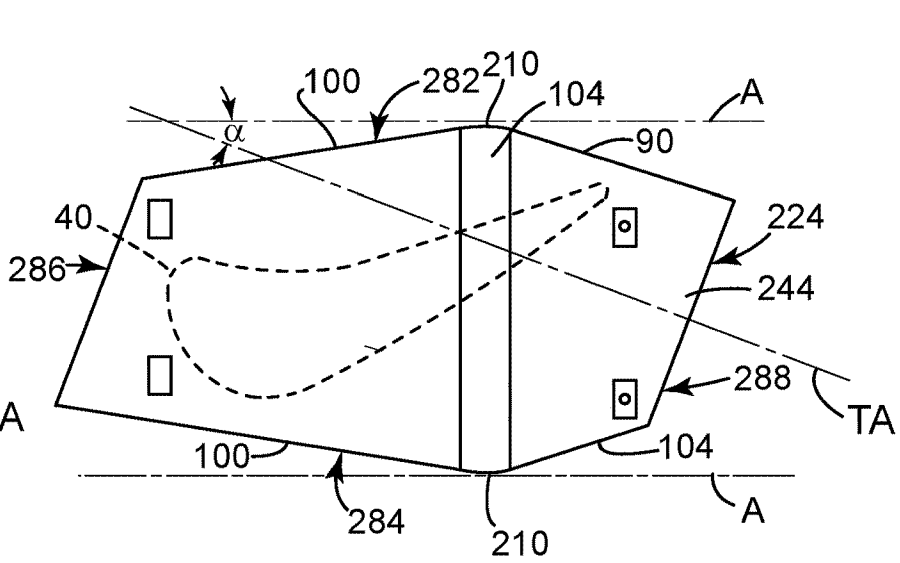
FIG. 22 is a top down view of an outer sidewall of a nozzle, according to additional embodiments of the disclosure (view similar to that along line Y-Y in FIG. 3).
Figure 21:
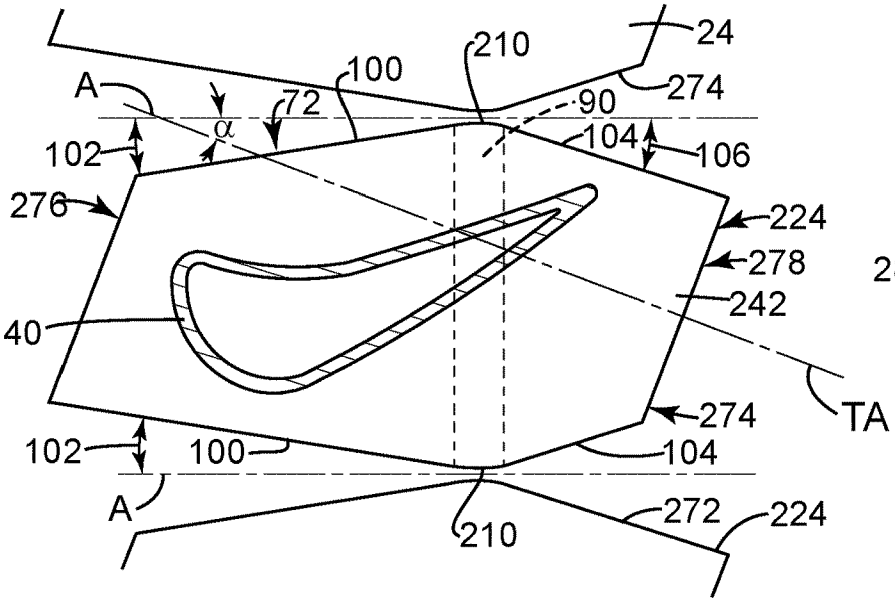
FIG. 21 is a cross-sectional view of an inner sidewall of a nozzle, according to additional embodiments of the disclosure (view similar to that along line X-X in FIG. 3)

In another embodiment, illustrated by FIGS. 18 and 21 and by FIGS. 17 and 22, only one sidewall on each nozzle 224 includes swept surfaces 100, 104 on both slash faces. That is, both slash faces on a given sidewall includes swept surfaces 100, 104, and the other sidewall has planar slash faces. FIGS. 18 and 21 show an embodiment in which both inner sidewall 242 pressure side slash face 272 and inner sidewall 242 suction side slash face 274 include swept surfaces 100, 104 (FIG. 21), while outer sidewall 244 on the same nozzle 224 includes planar slash faces 282, 284 (FIG. 18). In contrast, as shown in FIGS. 17 and 22, both outer sidewall 244 pressure side slash face 282 and outer sidewall 244 suction side slash face 284 include swept surfaces 100, 104 (FIG. 22), while inner sidewall 242 on the same nozzle 224 includes planar slash faces 272, 274 (FIG. 17).

Swept surfaces 100, 104, regardless of arrangement, create a non-uniform gap distance GD (FIG. 5 only) between slash faces of adjacent nozzles 24, 224 when mounted in the turbine system. The non-uniform gap distance GD can be customized for a particular nozzle 24, 224 and/or nozzle stage to accommodate any hot distortion. In any event, swept surfaces 100, 104 are advantageously located where each nozzle 24, 224 is stiffer and less prone to hot distortions, i.e., where the sidewall grows or deflects minimally relative to its original shape. Stiffening member 90 extends circumferentially on each nozzle 24, 224 to increase the stiffness, relative to areas without the stiffening member 90, such that the least amount of chordal deflection is observed in areas in close proximity to, or aligned with, the stiffening member 90.

In contrast, where sidewalls 42, 44, 242, 244 are not as stiff, more distance is provided via swept surfaces 100, 104 having a greater distance from a slash face of an adjacent nozzle 24, 224. Consequently, additional gap space is provided to accommodate hot distortions, i.e., growth, deflections, thermal expansion or other structural shifts, of sidewalls 42, 44, 242, 244 where necessary to prevent nozzle-to-nozzle interference, and less gap space is provided where hot distortions are less likely to cause nozzle-to-nozzle interference.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately" as applied to a particular value of a range applies to both end values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application and to enable others of ordinary skill in the art to understand the disclosure for various embodiments with various modifications as are suited to the particular use contemplated.

What is claimed is:

1. A nozzle for a turbine system, the nozzle comprising:

an airfoil including an exterior surface defining a pressure side and a suction side extending between a leading edge and a trailing edge, the airfoil further defining a tip and a root;

an inner sidewall connected to the airfoil at the tip, the inner sidewall including a peripheral edge defining a pressure side slash face, a suction side slash face, a leading edge face, and a trailing edge face;

an outer sidewall connected to the airfoil at the root, the outer sidewall including a peripheral edge defining a pressure side slash face, a suction side slash face, a leading edge face, and a trailing edge face; and a stiffening member extending circumferentially on at least one of a radially inner side of the inner sidewall and a radially outer side of the outer sidewall, wherein each of the inner sidewall pressure side slash face and the outer sidewall pressure side slash face includes a first swept surface extending at a first angle relative to a nominal slash face angle and a second swept surface extending at a second angle relative to the nominal slash face angle, the first swept surface and the second swept surface meeting at an arc having a peak that is circumferentially aligned with the stiffening member, wherein each of the inner sidewall suction side slash face and the outer sidewall suction side slash face includes a single planar surface, wherein the stiffening member is located only between 50% and 100% of a chordal axial length from the leading edge face toward the trailing edge face of the at least one of the inner sidewall and the outer sidewall.

2. The nozzle of claim 1, wherein each sidewall extends arcuately greater than 7°.

3. The nozzle of claim 1, wherein the first swept surface and the second swept surface create a non-uniform gap distance between slash faces of adjacent nozzles when mounted in the turbine system.

4. The nozzle of claim 1, wherein the stiffening member is located only between 60% and 75% of the chordal axial length from the leading edge face toward the trailing edge face of the at least one of the inner sidewall and the outer sidewall.

5. The nozzle of claim 1, wherein the first angle is between 0.1° and 0.4°, and the second angle is between 0.1° and 0.4° relative to the nominal slash face angle.

6. A nozzle assembly for a turbine system, the nozzle assembly comprising:

a plurality of nozzles disposed in an annular array and defining a hot gas path, each of the plurality of nozzles including:

an airfoil including an exterior surface defining a pressure side and a suction side extending between a leading edge and a trailing edge, the airfoil further defining a tip and a root;

an inner sidewall connected to the airfoil at the tip, the inner sidewall including a peripheral edge defining a pressure side slash face, a suction side slash face, a leading edge face, and a trailing edge face;

an outer sidewall connected to the airfoil at the root, the outer sidewall including a peripheral edge defining a pressure side slash face, a suction side slash face, a leading edge face, and a trailing edge face; and a stiffening member extending circumferentially on at least one of a radially inner side of the inner sidewall and a radially outer side of the outer sidewall, wherein each of the inner sidewall pressure side slash face and the outer sidewall pressure side slash face includes a first swept surface extending at a first angle relative to a nominal slash face angle and a second swept surface extending at a second angle relative to the nominal slash face angle, the first swept surface and the second swept surface meeting at an arc having a peak that is circumferentially aligned with the stiffening member, wherein each of the inner sidewall suction side slash face and the outer sidewall suction side slash face includes a single planar surface, wherein the stiffening member is located only between 50% and 100% of a chordal axial length from the leading edge face toward the trailing edge face of the at least one of the inner sidewall and the outer sidewall.

7. The nozzle assembly of claim 6, wherein the first swept surface and the second swept surface create a non-uniform gap distance between slash faces of adjacent nozzles of the plurality of nozzles in the annular array.

8. The nozzle assembly of claim 6, wherein the stiffening member is located only between 60% and 75% of the chordal axial length from the leading edge face toward the trailing edge face of the at least one of the inner sidewall and the outer sidewall.

9. The nozzle assembly of claim 6, wherein the first angle is between 0.1° and 0.4°, and the second angle is between 0.1° and 0.4° relative to the nominal slash face angle.

10. The nozzle assembly of claim 6, wherein the plurality of nozzles are first stage nozzles.

11. A gas turbine system, comprising:

a compressor section;

a combustor section; and a turbine section, the turbine section including a plurality of turbine stages, at least one of the plurality of turbine stages including a nozzle assembly, the nozzle assembly including a plurality of nozzles disposed in an annular array and defining a hot gas path, each of the plurality of nozzles comprising:

an airfoil comprising an exterior surface defining a pressure side and a suction side extending between a leading edge and a trailing edge, the airfoil further defining a tip and a root;

an inner sidewall connected to the airfoil at the tip, the inner sidewall including a peripheral edge defining a pressure side slash face, a suction side slash face, a leading edge face, and a trailing edge face;

an outer sidewall connected to the airfoil at the root, the outer sidewall including a peripheral edge defining a pressure side slash face, a suction side slash face, a leading edge face, and a trailing edge face; and a stiffening member extending circumferentially on at least one of a radially inner side of the inner sidewall and a radially outer side of the outer sidewall, wherein each of the inner sidewall pressure side slash face and the outer sidewall pressure side slash face includes a first swept surface extending at a first angle relative to a nominal slash face angle and a second swept surface extending at a second angle relative to the nominal slash face angle, the first swept surface and the second swept surface meeting at an arc having a peak that is circumferentially aligned with the stiffening member, wherein each of the inner sidewall suction side slash face and the outer sidewall suction side slash face includes a single planar surface, and wherein the stiffening member is located only between 50% and 100% of a chordal axial length from the leading edge face toward the trailing edge face of the at least one of the inner sidewall and the outer sidewall.

12. The gas turbine system of claim 11, wherein each of the first swept surface and the second swept surface create a non-uniform gap distance between slash faces of adjacent nozzles of the plurality of nozzles in the annular array.

13. The gas turbine system of claim 11, wherein each sidewall extends arcuately greater than 7° of the annular array.

14. The gas turbine system of claim 11, wherein the first angle is between 0.1° and 0.4°, and the second angle is between 0.1° and 0.4° relative to the nominal slash face angle.

* * * * *